US005613286A

United States Patent [19]

McCabe

[11] Patent Number: 5,613,286

[45] Date of Patent: Mar. 25, 1997

[54] APPARATUS FOR DESCALING WIRE

[75] Inventor: Troy A. McCabe, Rockford, Ill.

[73] Assignee: Fastener Engineers Group, Inc., Rockford, Ill.

[21] Appl. No.: 524,665

[22] Filed: Sep. 8, 1995

[51] Int. Cl.[6] ..... B21B 45/04; B21C 43/04

[52] U.S. Cl. ..... 29/81.04; 29/81.12; 15/88; 15/308

[58] Field of Search ..... 29/81.04, 81.12; 15/88, 306.1, 308

[56] References Cited

U.S. PATENT DOCUMENTS

| | | | |
|---|---|---|---|
| 781,078 | 1/1905 | Legnard | 29/81.04 |
| 2,804,196 | 8/1957 | Planett | 29/81.04 X |
| 2,821,365 | 1/1960 | Planett | 29/81.12 |
| 3,117,401 | 1/1964 | Talley | 15/88 X |
| 3,477,081 | 11/1969 | Schmidt | 15/88 |
| 3,702,489 | 11/1972 | Nakamura et al. . | |
| 3,988,798 | 11/1976 | Kratt | 15/88 |
| 4,286,449 | 9/1981 | Spreafico . | |
| 5,056,185 | 10/1991 | Schotter | 15/308 X |

FOREIGN PATENT DOCUMENTS

| | | | |
|---|---|---|---|
| 146272 | 7/1962 | U.S.S.R. | 15/88 |

*Primary Examiner*—S. Thomas Hughes
*Attorney, Agent, or Firm*—Vernon J. Pillote

[57] ABSTRACT

A wire cleaning apparatus in which three motor driven rotary wire brushes are mounted on a frame for rotation about axes generally radially of a wire pass line with the axes of the brushes being angularly and axially spaced apart relative to the pass line, and with the rotary brushes each having a bristle end face transverse to the axis of rotation and disposed adjacent the pass line so that the bristles of each brush move crosswise of the wire and in relatively opposite directions during each revolution of the brush. A wire guide shoe is associated with each of the wire brushes for guidably engaging and supporting the wire at a side of the pass line opposite the end face of the associated wire brush to control the position of the wire and the depth of penetrating the wire as it passes the end face of the associated brush.

14 Claims, 2 Drawing Sheets

APPARATUS FOR DESCALING WIRE

BACKGROUND OF THE INVENTION

It is known for example as disclosed in U.S. Pat. Nos. 3,702,489 and 4,286,449, to mechanically descale wire by passing the wire over rollers arranged to bend the wire in different planes to break and loosen scale on the wire, and thereafter pass the wire past the rotary brushes to clean the scale from the wire. The cleaned wire is commonly passed to a wire drawing machine or to some other machines that provides traction for pulling the wire through the descaling and cleaning apparatus.

U.S. Pat. No. 3,702,489 discloses three rotary wire brushes with generally radially extending bristles disposed with their plane of rotation inclined at an angle with respect to the wire being cleaned, with means for adjusting the radial position of the wire brushes with respect to the axis of the wire material to adjust the pressure at which the brushes are in brushing contact with the wire. U.S. Pat. No. 4,286,449 provides pairs of rotary wire brushes with generally radially extending bristles disposed at opposite sides of the path of movement of the wire, with the pairs of wire brushes rotating in a plane parallel to the wire flow. With this arrangement, the wire is able to separate the bristles of the wire brush and move below the outer periphery of the brush as shown in FIGS. 8 and 9 of the patent. Movement of the wire between the bristles of the brush reduces cleaning efficiency and increases wear and damage to the rotary brushes and this patent provides plates at opposite sides of the brushes for pressing the brushes against the wire and controlling spreading of the bristles as the bristles wear out.

In the above patents, the brushes are moved relative to the wire path to control the pressure applied by the brush to the wire. However, such arrangements do not accurately control the depth of penetration of the wire into the brush or the amount of wire cleaning.

SUMMARY OF THE INVENTION

The present invention overcomes the difficulties and disadvantages associated with prior art devices by providing a wire cleaning apparatus in which a plurality of motor driven rotary wire brushes are mounted on a frame for rotations about axes generally radially of the wire pass line with the axes of the brushes being angularly and axially spaced apart relative to the pass line, and with the rotary brushes having a bristle end face transverse to the axis of rotation and disposed adjacent the pass line so that the bristles of each brush move crosswise of the wire and in relatively opposite directions during each revolution of the brush, and with wire guide shoes associated with each of the wire brushes for guidably engaging and supporting the wire at a side of the pass line opposite the end face of the associated wire brush. With this arrangement the bristles on each rotary brush move crosswise of the wire in relatively opposite directions as the wire is advanced to not only enhance cleaning of the wire but to also control deflection of the wire by the rotating brushes. The wire guide engages the wire at the side opposite the bristle end face and controls the position of the wire and the depth of penetration of the wire into the end face of the associated brush.

The guide shoes are advantageously adjustable in a direction toward and away from the bristle end face of the associated brush to control the pressure exerted by the brush on the wire as the bristles move crosswise of the wire. The shoes are preferably arranged to shift away from the brush when engaged by a kink or sharp bend in the wire, to minimize damage to the shoe and brush.

The frame is advantageously arranged to form an enclosure for the wire brushes and shoes to confine the scale and dust removed from the wire. To remove loose dust particles from the wire, an air nozzle is provided at the wire outlet to pass a stream of pressurized air at the wire in a direction to dislodge and blow dust particles from the wire and back into the enclosure.

DETAILED DESCRIPTION

Figure 1:
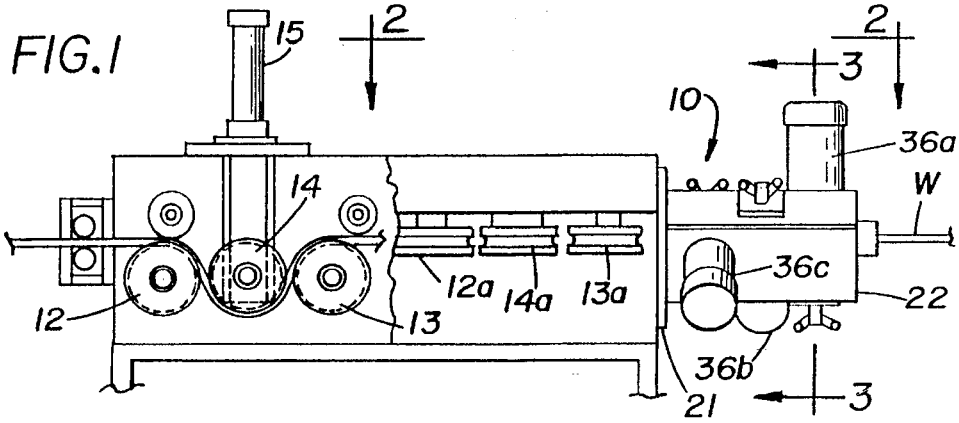
FIG. 1 is a fragmentary side view of a descaling apparatus embodying the wire cleaning apparatus of the present invention.
Figure 2:
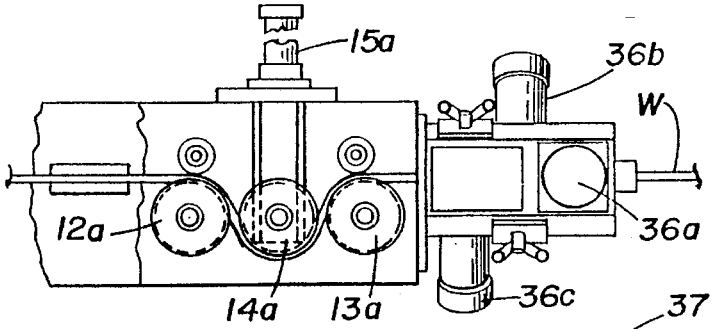
FIG. 2 is a fragmentary top view of the descaling apparatus of FIG. 1.

In the mechanical descaling of wire, it is common practice to draw the wire through a plurality of rollers so arranged that the wire is bent in different planes as it passes through the rollers to break and loosen the scale on the wire, after which the wire is passed through a wire cleaning apparatus having wire brushes to remove the scale and clean the wire. The wire cleaning apparatus of the present invention is shown in FIGS. 1 and 2 mounted on the outlet end of the roller type scale breaking apparatus. In the embodiment illustrated, the wire scale breaker includes a first set of rollers including breaker rollers 12 and 13 that are spaced apart along a wire pass line and a center roller 14 positioned in between the breaker rollers. The center roller 14 is movable as by a fluid actuator 15 between a position in which the wire can be fed through the rollers in a straight line during initial set-up of the machine, and a position in which the center roller is offset to bend the wire a predetermined amount and cause the wire scale to break and flake off as it passes the rollers. The rollers 12–14 are arranged to bend the wire in one plane, for example a vertical plane as shown in FIG. 1 and a second set of rollers 12*a*, 13*a* and 14*a* are provided and arranged to bend the wire in a second plane as shown in FIG. 2. A fluid actuator 15*a* is also provided for moving the intermediate roller between a position in which the wire can be passed straight through during set-up and a position in which the wire is bent as it passes through the rollers. The amount of bending required to break the scale will vary with different types and sizes of wires and the pressures supplied to actuators 15 and 15*a* is preferably made adjustable to adjust the amount of bending of the wire.

Figure 3:
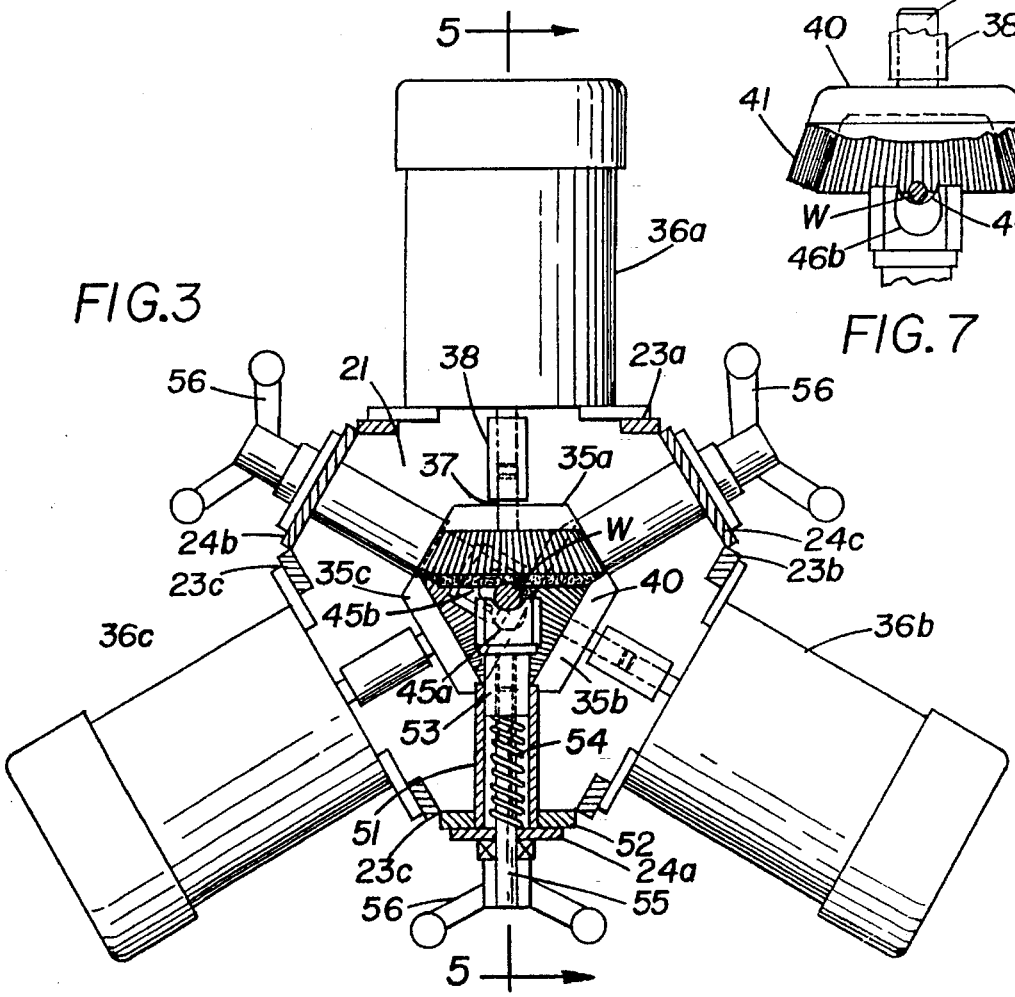
FIG. 3 is a transverse sectional view through the wire cleaning apparatus taken on the plane 3—3 of FIG. 1 and illustrating parts on a larger scale.

The wire cleaning apparatus 10 is mounted so as to receive the wire after it is passed through the scale breaking rollers to mechanically brush and remove the scale from the wire. The wire cleaning apparatus has a frame arranged to support three brush drive motors and brushes and three wire guides at angularly spaced locations around a wire pass line. In the preferred embodiment shown, the frame is in the form of a weldment having end panels 21 and 22, three motor mount panels 23*a*, 23*b* and 23*c*, and three shoe mounting panels 24*a*, 24*b* and 24*c*. As best shown in FIG. 3, the motor mount panels are disposed in a generally triangular array around a wire pass line designated PL, and the shoe mounting panels are also disposed in a generally triangular array with side edges of the panels 24*a*, 24*b* and 24*c* secured as by welding to the adjacent motor mount panels 23*a*–23*c*. A wire inlet guide 31 (FIG. 5) is secured to one of the end panels 21 and has a wire guide opening 31*a* and has a wire guide passage 31*a* for guiding the wire along the pass line PL as the wire enters the cleaner, and a wire outlet guide 33 is mounted on the other end panel for guiding the wire along the pass line PL as the wire exits from the cleaner.

Figure 7:
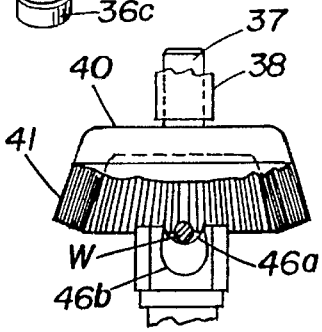
FIG. 7 is a fragmentary sectional view of a brush and wire guide shoe.
Figure 4:
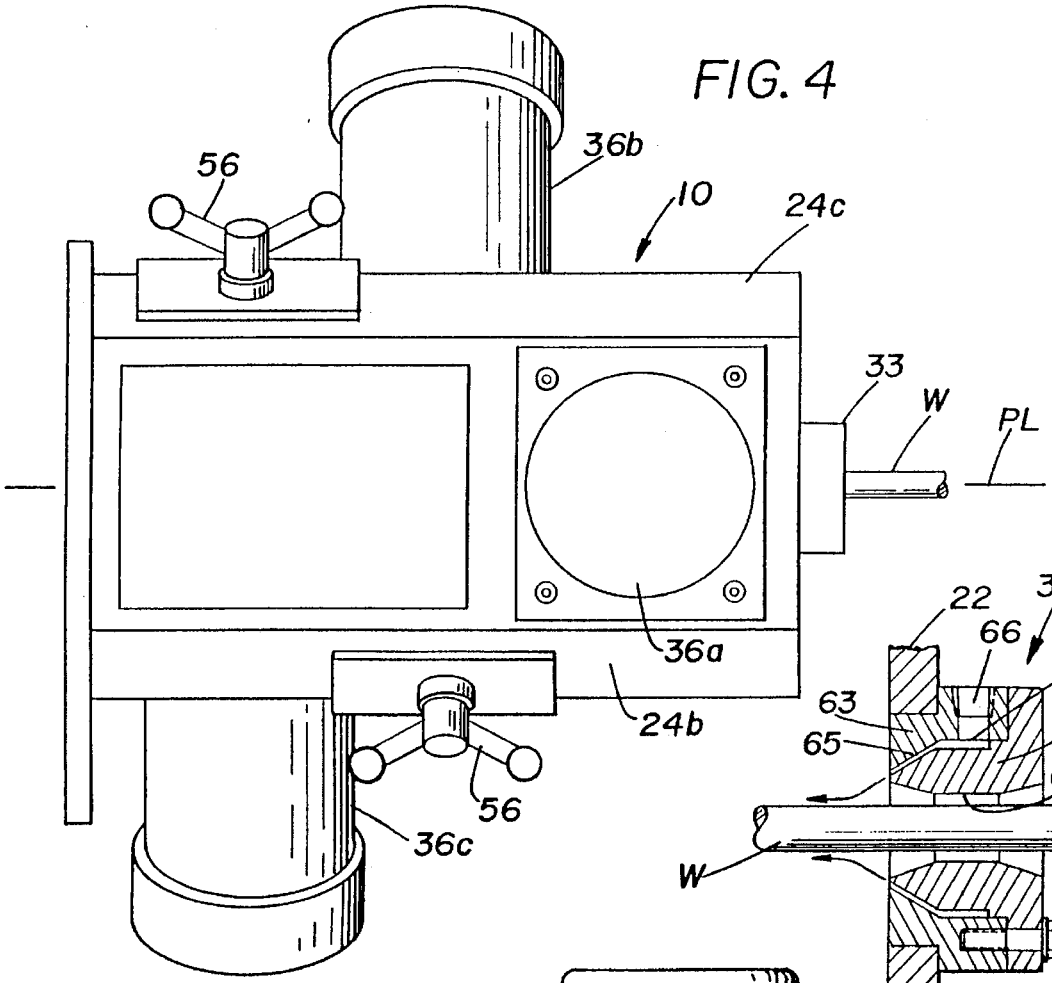
FIG. 4 is a top view of the wire cleaning apparatus of FIG. 3.

The wire cleaning apparatus has a plurality, preferably three wire cleaning brushes designated 35*a*, 35*b* and 35*c* that are driven by motors 36*a*–36*c* about axes disposed generally radially of the wire pass line PL that extends between the inlet and outlet guides, with the axes angularly and axially spaced apart relative to the wire pass line. The wire brushes are of like construction, and as best shown in FIGS. 3,4 and 7, each have a stem 37 that are coupled by a coupling 38 to an associated one of the motor shafts 39. The rotary wire brushes are of the type having a bristle end face disposed generally transverse to the brush axis and are preferably of the cup type shown in which the bristles 41 are mounted in a cup-shaped holder 40 and extend axially and outwardly in an annular frusto-conical array. It is also contemplated that the brushes can be of a cylindrical type in which the bristles extend generally parallel to the axis of rotation. The motors 36*a*–36*c* are removably mounted on the motor mount panels 23*a*–23*c*, respectively as by bolts and the brushes are arranged so that the bristle end face is disposed adjacent the wire pass line PL. As will be seen from FIGS. 5 and 7, with this arrangement, the wire bristles move crosswise of the wire pass line and hence crosswise of the wire W twice during each revolution of the brush, first in one direction as the wire advances from one edge of the brush end face toward the axis of the brush and in the opposite direction as the wire moves from the axis of the brush to the outer periphery at the outlet side of the brush. Accordingly, each brush exerts a drag on the wire in two opposite directions as the wire passes the end face of the brush.

Figure 5:
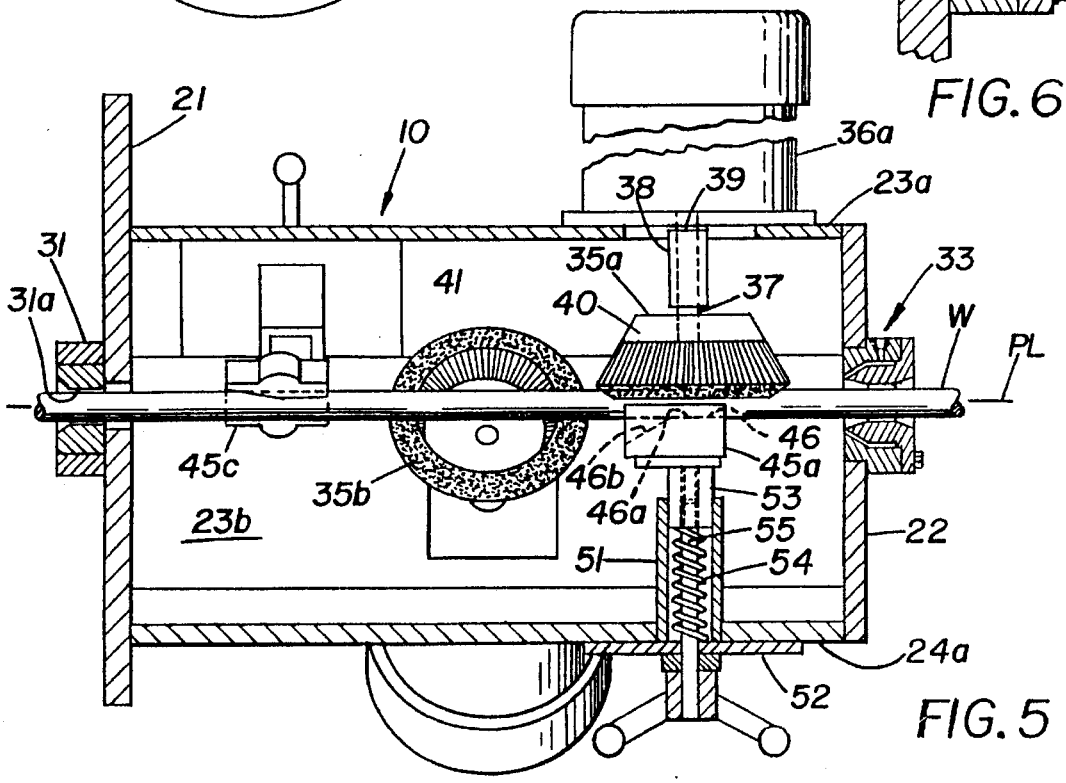
FIG. 5 is a longitudinal vertical sectional view through the wire cleaning apparatus taken on the plane 5—5 of FIG. 3.

Three wire guide shoes 45*a*, 45*b*, and 45*c* (FIGS. 3 and 5) are mounted on the frame and are each associated with a respective one of the wire brushes for guidably engaging and supporting the wire at a side of the wire pass line PL opposite the bristle end face of the associated brush. The wire guide shoes are of like construction and each have a generally U-shaped groove on the side adjacent the pass line for guidably receiving the wire along the wire pass line. As best shown in FIGS. 3,5 and 7, the outlet portion 46*a* of the groove in the wire guide shoe has a transverse curvature larger than the wire and extends generally parallel to the wire pass line, and the inlet portion 46*b* converges toward the pass line to aid in guiding a kink or bend in the wire into the outlet portion 46*a*. The guide shoes are dimensioned such that the portion of the shoe adjacent the bristle end face is smaller than the internal cavity in the cup-shaped brushes so that the shoes can project into open end of the brush to support and laterally guide the wire without contacting the brush.

The wire engaging shoes are mounted on the frame for adjustment in a direction generally radially of the wire pass line and, in order to limit damage to the shoe and/or brush in the event of a sharp bend or kink in the wire, the shoe is advantageously yieldably biased in a direction toward the end face of the associated brush with adjusting means for limiting movement of the shoe by the yieldable means in a direction toward the brush. In the embodiment illustrated, each shoe mount includes a guide 51, conveniently a square tube mounted on a plate 52. An inner guide 53 is slidably and non-rotatably received in the tube and fixed to the shoe. The inner guide 53 is yieldably urged in a direction toward the pass line by a spring 54 and a rod 55 is threadedly attached to the guide 53 and extends through plate 52. A means such as a T-handle 56 fixed on the outer end of the rod 55, can be manually turned to adjust the movement of the shoe in a direction toward the pass line, while yet allowing the shoe to move outwardly away from the pass line in the event of a sharp bend or kink in the wire. Preferably, these shoes are attached to the inner guide 53 at a location adjacent the outlet end of the shoe as shown in FIG. 5.

The wire guide shoes 45*a*, 45*b*, 45*c* are mounted on panels 24*a*–24*c* at locations such that the wire guide shoes 45*a*, 45*b* and 45*c* guidably engage and support the wire at a side of the wire pass line opposite the bristle end face of the associated wire brushes 35*a*–35*c*. The wire guides are thus longitudinally and angularly spaced apart about the wire pass line and cooperate in radially guiding the wire as it passes through the wire cleaning apparatus.

Figure 6:
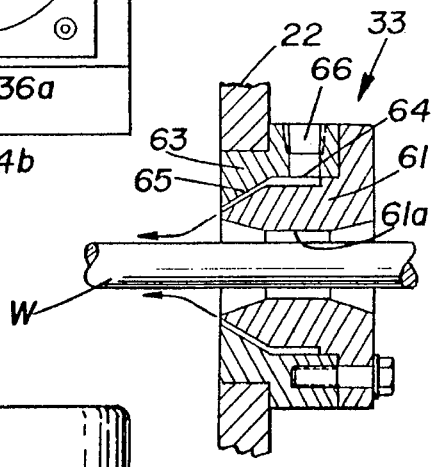
FIG. 6 is a sectional view through the wire outlet guide and air jet nozzle.

The frame structure is preferably arranged to form an enclosure with the brushes and wire guides inside the enclosure and the motors outside the enclosure, to confine the scale particles and dust within the enclosure. In order to remove particles that may cling to the wire and to minimize transfer of dust particles to the atmosphere, provision is made for directing a conical air jet at the wire as it passes into the outlet guide, to blow these articles off the wire and back into the enclosure. As best shown in FIG. 6, the outlet guide 33 includes an inner member 61 having an internal guide passage 61*a* for guiding the wire as it exits from the wire cleaner, and an outer member 63 that extends around the inner member and forms an annular nozzle 64 therebetween. The nozzle is formed with a conical discharge end 65 for directing an air stream toward the wire as it exits from the wire cleaner. The nozzle has an air inlet 66 which can be connected to any suitable source of air supply such as plant air supply, preferably through a pressure regulator.

From the foregoing it is believed that the construction and operation of the wire cleaning apparatus will be readily understood. The rotary wire brushes are rotated about axes extending generally radially of the wire pass line, at locations angularly and axially spaced apart relative to the wire pass line. The brushes have bristle end faces transverse to the axis of rotation so that the bristles contact the wire during movement crosswise of the wire and in relatively opposite directions during each revolution of the brush. The wire guides are disposed at the side of the pass line opposite the end face of the wire brush to laterally guide and adjustably control the depth of penetration of the wire into the end face of the brush and thereby control the pressure exerted by the brush on the wire.

The embodiments of the invention in which an exclusive property or privilege is claimed are defined as follows:

1. An apparatus for cleaning wire as it is advanced through the apparatus comprising: a support frame having a wire inlet guide and a wire outlet guide, a plurality of brush drive motors mounted on the frame and each having a motor shaft disposed generally radially of a wire pass line extending between the inlet and outlet guides, the motor output shafts being angularly and axially spaced apart relative to the wire pass line, a rotary wire brush having an axis of rotation and a bristle end face transverse to the axis of rotation mounted on each motor shaft for rotation thereby with the bristle end face adjacent the pass line, and a plurality of wire guide shoes mounted on the frame each associated with a respective one of the wire brushes for guidably engaging and supporting a wire at a side of the pass line opposite the bristle end face of the associated wire brush.

2. An apparatus for cleaning wire according to claim 1 wherein said apparatus has three of said brush drive motors with the shafts angularly spaced about 120 degrees.

3. An apparatus for cleaning wire according to claim 1 wherein said wire engaging shoes are mounted on the frame for adjustment relative to the wire pass line to adjust the position of the shoe relative to the bristle end face of the associated brush.

4. An apparatus according to claim 1 wherein each wire guide shoe is mounted on the frame for movement toward and away from the pass line, spring means yieldably urging each shoe in a direction toward the end face of the associated brush, and means for adjustably limiting movement of each shoe by said spring means in a direction toward the pass line to adjust the position of the shoe relative to the bristle end face of the associated brush.

5. An apparatus according to claim 1 wherein said support frame is configured to form an enclosure, said wire brushes and said shoes being disposed in said enclosure, said frame including a nozzle opening at the inner side of the enclosure for directing pressurized air at the wire pass line adjacent the outlet guide.

6. An apparatus according to claim 1 wherein said wire brushes have a cup-shaped configuration.

7. An apparatus according to claim 1 wherein the wire brushes have a cup-shaped configuration providing an internal cavity that opens at the bristle end face, the portion of the guide shoes adjacent the bristle end face being smaller than the internal cavity so that the shoes can project into brush to support and laterally guide the wire without contacting the brush.

8. In a wire descaling apparatus having a scale breaking mechanism for bending a wire in different planes as the wire is advanced lengthwise to break and loosen the scale on the wire and a brush type wire cleaning mechanism for cleaning the wire after it exits from the scale breaking mechanism, the improvement wherein said wire cleaning mechanism comprises a support frame having a wire inlet guide at one end for receiving wire from the scale breaking mechanism and a wire outlet guide at a remote end, a plurality of brush drive motors mounted on the frame and each having a motor output shaft disposed generally radially of a wire pass line extending between the inlet and outlet guides, the motor output shafts being angularly and axially spaced apart relative to the wire pass line, a rotary brush having an axis of rotation and a bristle end face transverse to the brush axis of rotation mounted on each motor output shaft for rotation thereby with the bristle end face adjacent the wire pass line, and a plurality of wire guide shoes mounted on the frame each associated with a respective one of the the wire brushes for guidably engaging and supporting wire at a side of the pass line opposite the bristle end face of the associated wire brush.

9. In a descaling apparatus according to claim 8 wherein said apparatus has three of said brush drive motors with the shafts angularly spaced about 120 degrees.

10. In a descaling apparatus according to claim 8 wherein said wire engaging shoes are mounted on the frame for adjustment relative to the wire pass line to adjust the position of the shoe relative to the bristle end face of the associated brush.

11. In a descaling apparatus according to claim 8, wherein each wire guide shoe is mounted on the frame for movement toward and away from the pass line, spring means yieldably urging each shoe in a direction toward the associated brush end face, and manually adjustable means for adjustably limiting movement of each shoe by said spring means in a direction toward the pass line to adjust the position of the shoe relative to the bristle end face of the associated brush.

12. In a descaling apparatus according to claim 8 wherein said support frame is configured to form an enclosure, said wire brushes and said shoes being disposed in said enclosure, said frame including a nozzle opening at the inner side of the enclosure for directing pressurized air at the wire pass line adjacent the outlet guide.

13. In a descaling apparatus according to claim 8 wherein said wire brushes have a cup-shaped configuration.

14. In a descaling apparatus according to claim 8 wherein the wire brushes have a cup-shaped configuration providing an internal cavity that opens at the bristle end face, the portion of the guide shoes adjacent the bristle end face being smaller than the internal cavity so that the shoes can project into the brush to support and laterally guide the wire without contacting the brush.

* * * * *